US010239055B2

(12) United States Patent
Hintikka

(10) Patent No.: US 10,239,055 B2
(45) Date of Patent: Mar. 26, 2019

(54) PIPETTE WITH A TIP REMOVAL MECHANISM, A METHOD FOR REMOVING A TIP, AND A METHOD FOR PIPETTING

(71) Applicant: SARTORIUS BIOHIT LIQUID HANDLING OY, Helsinki (FI)

(72) Inventor: Ville Juhani Hintikka, Espoo (FI)

(73) Assignee: SARTORIUS BIOHIT LIQUID HANDLING OY, Helsinki (FI)

( * ) Notice: Subject to any disclaimer, the term of this patent is extended or adjusted under 35 U.S.C. 154(b) by 160 days.

(21) Appl. No.: 15/197,006

(22) Filed: Jun. 29, 2016

(65) Prior Publication Data

US 2017/0001189 A1 Jan. 5, 2017

(30) Foreign Application Priority Data

Jun. 30, 2015 (EP) ..... 15397531

(51) Int. Cl.
*B01L 3/00* (2006.01)
*B01L 3/02* (2006.01)

(52) U.S. Cl.
CPC ..... *B01L 3/0217* (2013.01); *B01L 3/0279* (2013.01); *B01L 2200/026* (2013.01); *B01L 2300/06* (2013.01)

(58) Field of Classification Search
CPC ..... B01L 3/0217
USPC ..... 436/180
See application file for complete search history.

(56) References Cited

U.S. PATENT DOCUMENTS

| | | | |
|---|---|---|---|
| 5,435,197 | A | 7/1995 | Telimaa et al. |
| 2003/0147781 | A1 | 8/2003 | Viot |
| 2007/0272037 | A1 | 11/2007 | Telimaa et al. |
| 2013/0095508 | A1 | 4/2013 | Campitelli et al. |
| 2013/0199312 | A1 | 8/2013 | Wilmer et al. |

FOREIGN PATENT DOCUMENTS

| | | | |
|---|---|---|---|
| WO | WO 91/05609 | A1 | 5/1991 |
| WO | WO 2014/016282 | A1 | 1/2014 |

OTHER PUBLICATIONS

European Search Report issued in EP 15 39 7531 dated Dec. 18, 2015.

*Primary Examiner* — Christine T Mui
*Assistant Examiner* — Emily R. Berkeley
(74) *Attorney, Agent, or Firm* — Birch, Stewart, Kolasch & Birch, LLP

(57) ABSTRACT

The present invention relates to a pipette comprising a tip removal mechanism adapted for lifting an inner mechanism of the pipette with regard to a body of the pipette when the user presses the tip removal button. The present invention further relates to a method for disengaging a disposable tip attached to a tip cone of a pipette of the present invention, and to a method for pipetting with a pipette according to the present invention.

8 Claims, 1 Drawing Sheet

PIPETTE WITH A TIP REMOVAL MECHANISM, A METHOD FOR REMOVING A TIP, AND A METHOD FOR PIPETTING

FIELD OF THE INVENTION

The present invention relates to a mechanism for removing a disposable tip from a pipette.

BACKGROUND OF THE INVENTION

Pipettes are hand-held liquid dispensing devices that are used for delivering a precisely defined amount of liquid from one receptacle to another receptacle. Liquid is aspirated into and delivered from a disposable tip that is attached to a lower end of the pipette.

In air displacement pipettes, downward thumb action on a control knob moves a plunger downward within a cylinder from an upper stop against the upward bias of a return spring to a lower stop, whereby air is displaced from the cylinder. To aspirate a desired volume of liquid into the tip, the user places an end of the tip in a sample liquid and releases the control knob to allow the return spring to return the plunger to the upper stop. Finally, to dispense the desired volume of liquid, the user moves the tip of the pipette to a receptacle for receiving the liquid and presses the control knob with his thumb to move the plunger from the upper stop to the lower stop. The amount of liquid aspirated and dispensed corresponds to the volume of displaced air.

A pipette typically has a mechanism for the removal of the tip so that the user does not need to pull off the tip by grasping it manually. The tip is held in place at the lower end of a pipette's tip cone by friction. To detach the tip, the user presses a tip removal button that is operable by the user's thumb and typically located in the upper part of the pipette, near the control knob that is used for aspirating and dispensing. The mechanism comprises a removal sleeve sliding on a cylinder part of the pipette and an arm fixed thereto and sliding in the handle of the pipette or on its side. The mechanism is connected with a spring, which pushes the arm into the upper position. When the arm is pressed downwards, the sleeve disengages the tip attached to the tip cone, i.e. the end of the cylinder.

Different solutions for realising the tip removal mechanism are known in the prior art:

U.S. Pat. No. 5,435,197 describes a tip remover that is based on a lever mechanism. The lever projects sideways from the frame of the pipette, and the arm of the tip remover is articulated between the ends of the lever. The end on the side of the frame of the lever is best formed into a gear, which is in mesh with a toothing in the direction of the arm in the pipette frame.

US 2003/0147781 A1 describes a pipette comprising a body; an arm movable relative to the body parallel to a longitudinal direction of the pipette in order to eject a cone fixed to the body; and a button for controlling movement of the arm. The pipette is arranged in such a manner that the button applies sliding thrust on the arm while the arm is moving relative to the body.

US 2007/0272037 A1 describes a tip removing mechanism that comprises a rotatable ramp member, having a circle-forming ramp surface with one or more segments, each of said segments having a top position and a bottom position on the ramp surface. In a basic condition, the remover element is in the top position. In response to its rotation, the ramp member forces the remover element towards the tip. A segment is followed by stopping the ramp member at the commencement of a next segment and a new tip can be attached to the pipette. The mechanism can be provided with a spring for returning the remover element. The ramp member can be rotated by means of a motor, such as an electric motor. Stopping of the motor after a segment is most preferably performed automatically. Here the removal function of the tip is effected by means of a one-way rotating action.

The above described known tip removal mechanisms are based on a sleeve mechanism in which the tip is subjected to a downward directed force submitted by the sleeve. The force is generated by the user's finger to overcome the friction between the tip and the tip cone. Once the required force is reached, the tip will fall off and become detached, and the sleeve will continue to move in an accelerated manner to its lower stop. The result is an abrupt removal of the tip with a high speed, since the user is not able to fully control the removal speed. When removing a tip, the user typically needs to direct the tip towards a container that is preferably located farther away, as it is not desirable to shoot the tip with a high speed against a nearby desk surface or a container. A major disadvantage of the known removal mechanisms is the spreading of aerosols upon high-speed tip removal, which results in contamination problems.

When the tip removal mechanism is based on a sleeve or a side-arm that is adapted for pushing the tip, the construction of the pipette becomes bulky and larger than what is needed for accommodating the user's hand. In addition, the required force to push the removal button is usually relatively high, which may lead to fatigue of the user's thumb. Thus, the known tip removal mechanisms are not optimal in view of ergonomics.

In addition, because the above-described ejector sleeve is a moving part, at least one seam is formed between the sleeve and the handle or body of the pipette. Such a seam is prone to collect dirt over time, which is highly undesirable.

The present invention is directed to overcome the above described disadvantages present in the known tip removal mechanisms.

The present invention provides a controlled removal that resembles gentle dropping of the tip thus avoiding spreading of aerosols. Further, the present invention improves the construction and ergonomics of the pipette and makes the pipette more robust and compact.

SUMMARY OF THE INVENTION

The present invention provides a pipette comprising a body, a plunger mechanism comprising a plunger movable inside a cylinder, which plunger mechanism is located inside the body and adapted for aspirating liquid into the cylinder and for dispensing the liquid, a control knob adapted for actuating the plunger mechanism, a tip cone adapted for receiving a disposable tip and for holding it in place by means of friction, a tip removal mechanism adapted for disengaging the disposable tip attached to the tip cone when the user presses a tip removal button, wherein the tip removal mechanism is adapted for lifting an inner mechanism of the pipette with regard to the body when the user presses the tip removal button, wherein the inner mechanism comprises at least the tip cone, for making the disposable tip contact a lower part of the body, and for disengaging the tip.

According to an embodiment, the body of the pipette comprises at least a handle and a sleeve that is adapted for contacting or ejecting a tip, wherein the handle and the sleeve are fixed to each other.

According to an embodiment, the inner mechanism further comprises the plunger mechanism.

According to a preferred embodiment, the pipette further comprises a lock that is adapted for inactivating the tip removal mechanism as a user is attaching a tip to the tip cone, wherein the lock is adapted to essentially prevent an upward movement of at least the tip cone.

According to the preferred embodiment, the pipette comprises a loading spring that is stiffer than a return spring of the tip removal mechanism.

According to an embodiment, the pipette is a hand-held single-channel mechanical pipette.

According to an embodiment, the pipette is a hand-held multichannel mechanical pipette. In this embodiment, all tip cones are lifted until all tips have been disengaged. Thus the removal of multiple tips becomes more effective, coordinated and reliable than in known tip removal mechanisms where multiple tips are pushed off by an ejector sleeve or ejector bar based mechanism.

According to an embodiment, the pipette is a hand-held electronic pipette.

The present invention further provides a method for disengaging a disposable tip attached to a tip cone of a pipette, comprising:

pressing a tip removal button by a user, lifting an inner mechanism of the pipette with regard to a body of the pipette as the user is pressing the tip removal button, which inner mechanism comprises at least the tip cone.

making the disposable tip contact a lower part of the body of the pipette to disengage the tip upon said lifting.

According to an embodiment, a pipette according to the present invention is used in the method.

The present invention further provides a method for pipetting, comprising attaching a tip to a tip cone of the pipette, aspirating a volume of liquid into the tip, dispensing the volume of liquid, removing the tip, wherein a pipette according to the present invention used.

BRIEF DESCRIPTION OF THE DRAWINGS

FIG. 1 shows the pipette without a tip, in a rest position.

FIG. 2 shows the pipette in a state where a tip is being attached.

FIG. 3 shows the pipette with the tip attached, in a rest position.

FIG. 4 shows the pipette in a state where the tip removal button is being pressed and the tip has been disengaged.

DETAILED DESCRIPTION OF THE INVENTION

A pipette according to the present invention is described in the following with reference to the drawings.

While the present invention is described in the following with reference to a single-channel hand-held mechanical pipette, it should be understood that the present invention is also suitable for other corresponding applications, such as multichannel pipettes and electronic pipettes.

Figure 1:
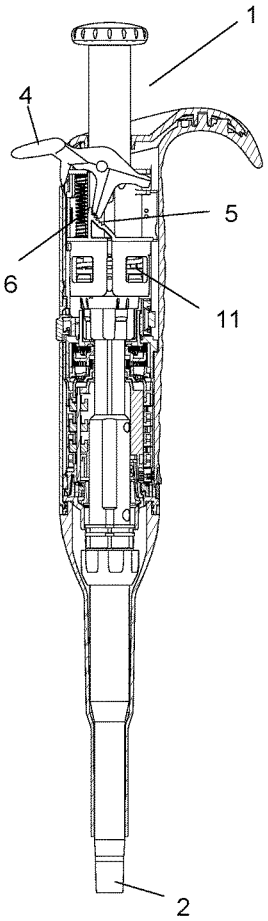
FIGS. 1 to 4 show cross-sectional views of a pipette according to an embodiment of the present invention.

FIG. 1 shows a pipette 1. The pipette comprises a tip cone 2, a tip removal button 4, a lock 5 of the tip removal button, and a return spring 6 of the tip removal button 4. In FIG. 1 the pipette is shown without a tip, in a rest position.

The principle underlying the present invention is that instead of pushing a stationary tip by a moving sleeve, at least the tip cone is pulled upwards so that the tip contacts a stationary sleeve.

Preferably, the pipette comprises a tip loading mechanism that allows tips to be loaded with a constant force. In this case the pipette comprises a loading spring 11 that is stiffer than the return spring 6 of the tip removal button 4.

Figure 2:
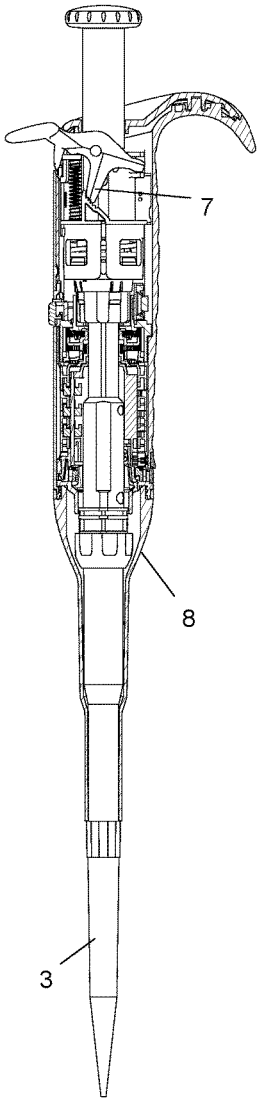

FIG. 2 shows the pipette in a state where a tip 3 is being picked by a user to the tip cone 2. Here, the inner mechanism of the pipette (i.e. the mechanism internal to the body 8), including the cylinder, has been lifted upwards by a small distance. Upon the picking action, a lock 5 of the tip removal button 4 becomes activated and locks or inactivates the tip removal button. The toothing of the lock 5 contacts the leg 7 that is connected to the tip removal button 4. The lock 5 is needed to prevent further upward movement of the inner mechanism. If the tip removal button could not be locked in this way, the tip removal button would have to be provided with an extremely stiff return spring to prevent the inner mechanism of the pipette from escaping upwards during tip picking.

Figure 3:
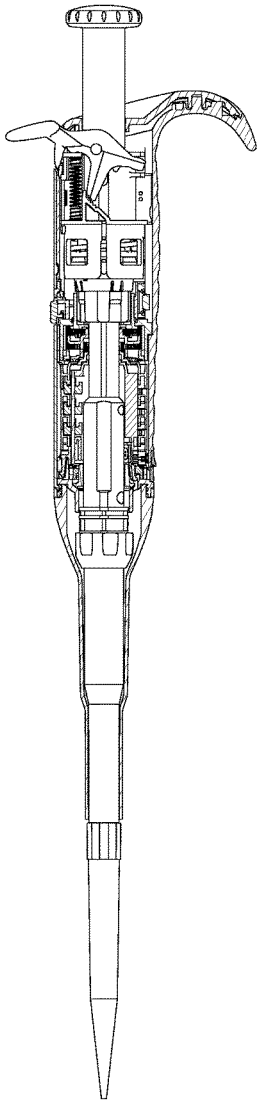

FIG. 3 shows the pipette 1 with the tip attached, again in a rest position. In the rest position, the leg 7 mostly/substantially does not contact the toothing of the lock 5.

Figure 4:
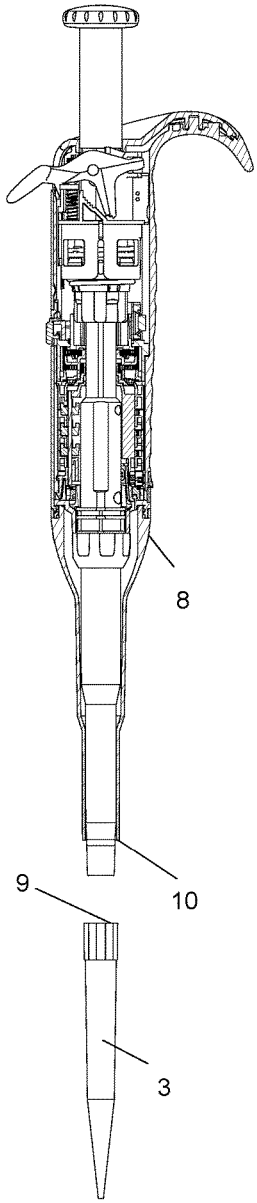

FIG. 4 shows the pipette in a state where the tip removal button 4 is being pressed and the tip 3 has been disengaged.

When the user desires to remove the tip 3 from the tip cone 2, he presses the tip removal button 4. Thereupon the tip cone 2, together with the rest of the inner mechanism of the pipette, is lifted and withdrawn inside the sleeve-formed body 8 of the pipette by a distance that is larger than during the picking action. The body of the pipette remains stationary. As the upper edge 9 of the tip contacts the lower edge 10 of the body 8, the tip 3 becomes disengaged from the tip cone and drops off. The tip removal mechanism is based on a relatively light return spring 6.

Preferably, the pipette comprises an Optiload tip loading mechanism as used in the Sartorius mLINE pipettes (mLINE is a registered trademark of Sartorius AG).

The present invention can be applied to an electronic pipette. Even in this case the tip removal mechanism would be manually operated.

By using the present invention, it is possible to have an integral and continuous outer structure in the body of the pipette, as there is no separate sleeve moving downwards with regard to the rest of the pipette body. Therefore, the length of the pipette body can be reduced and the pipette body may have a smooth and integral outer construction, which facilitates cleaning and avoids collecting dirt.

The invention claimed is:

1. A pipette, comprising:

a body, a plunger mechanism comprising a plunger movable inside a cylinder, the plunger mechanism is located inside the body and adapted for aspirating liquid into a disposable tip and for dispensing the liquid, a control knob adapted for actuating the plunger mechanism, a tip cone adapted for receiving the disposable tip and for holding it in place by means of friction, a tip removal button, a return spring operatively connected to the tip removal button, wherein:

the tip cone is adapted, upon pressing of the tip removal button, to be withdrawn inside the body so that the tip contacts a lower part of the body and the tip becomes disengaged.

2. The pipette of claim 1, wherein the body of the pipette comprises at least a handle and a sleeve that is adapted for contacting the tip when the tip cone is withdrawn inside the body, wherein the handle and the sleeve are fixed to each other.

3. The pipette of claim 1, wherein:

the pipette comprises an inner mechanism which comprises the tip cone and the plunger mechanism; and the inner mechanism is adapted, upon pressing of the tip removal button, to be withdrawn inside the body so that the tip contacts a lower part of the body and the tip becomes disengaged.

4. The pipette of claim 1, further comprising a lock that is adapted to prevent an upward movement of at least the tip cone when a user is attaching a tip to the tip cone.

5. The pipette of claim 4, wherein the pipette comprises a loading spring that is stiffer than the return spring of the tip removal button.

6. The pipette of claim 1, in which the pipette is a hand-held single-channel mechanical pipette.

7. The pipette of claim 1, in which the pipette is a hand-held multichannel mechanical pipette.

8. The pipette of claim 1, in which the pipette is a hand-held electronic pipette.

* * * * *